US009605928B2

(12) United States Patent
Oxford et al.

(10) Patent No.: US 9,605,928 B2
(45) Date of Patent: Mar. 28, 2017

(54) APPARATUS AND METHOD FOR BROAD SPECTRUM RADIATION ATTENUATION

(71) Applicants: J. Craig Oxford, Nashville, TN (US); D. Michael Shields, St. Paul, MN (US)

(72) Inventors: J. Craig Oxford, Nashville, TN (US); D. Michael Shields, St. Paul, MN (US)

( * ) Notice: Subject to any disclaimer, the term of this patent is extended or adjusted under 35 U.S.C. 154(b) by 0 days.

(21) Appl. No.: 14/507,889

(22) Filed: Oct. 7, 2014

(65) Prior Publication Data

US 2015/0020679 A1 Jan. 22, 2015

Related U.S. Application Data

(63) Continuation of application No. 13/751,696, filed on Jan. 28, 2013, now Pat. No. 8,850,947, which is a continuation of application No. 11/901,698, filed on Sep. 17, 2007, now Pat. No. 8,359,965.

(51) Int. Cl.

| | |
|---|---|
| ***F41H 5/02*** | (2006.01) |
| ***F41H 5/04*** | (2006.01) |
| ***F41H 3/00*** | (2006.01) |
| ***F41H 5/06*** | (2006.01) |
| ***F41H 5/08*** | (2006.01) |
| ***F41H 5/24*** | (2006.01) |

(52) U.S. Cl.

CPC ..... *F41H 5/0442* (2013.01); *F41H 3/00* (2013.01); *F41H 5/04* (2013.01); *F41H 5/0457* (2013.01); *F41H 5/0471* (2013.01); *F41H 5/06* (2013.01); *F41H 5/08* (2013.01); *F41H 5/24* (2013.01)

(58) Field of Classification Search

CPC ..... F41H 5/0042; F41H 5/0457

USPC ..... 89/36.01, 36.17

See application file for complete search history.

(56) References Cited

U.S. PATENT DOCUMENTS

| | | | | |
|---|---|---|---|---|
| 3,592,288 | A | 7/1971 | Walter | |
| 4,083,395 | A * | 4/1978 | Romano | E06B 3/481 160/199 |
| 4,121,645 | A | 10/1978 | Behr | |
| 4,241,457 | A * | 12/1980 | Klein et al. | 2/2.5 |
| 4,774,148 | A * | 9/1988 | Goto | 428/607 |
| 4,822,657 | A * | 4/1989 | Simpson | 428/69 |
| 4,870,908 | A * | 10/1989 | Wolters | A47B 83/001 108/60 |
| 4,959,504 | A * | 9/1990 | Yarger et al. | 174/386 |
| 5,007,473 | A | 4/1991 | Evensen | |
| 5,069,011 | A | 12/1991 | Jenne | |
| H001061 | H * | 6/1992 | Rozner et al. | 89/36.02 |

(Continued)

OTHER PUBLICATIONS

"Closed Cell Metal Foam" online brochure from READE, retrieved on Jul. 12 2016.*

(Continued)

*Primary Examiner* — Samir Abdosh

(74) *Attorney, Agent, or Firm* — Wayne Edward Ramage; Baker Donelson

(57) ABSTRACT

A system of panels for use in assembling a radiation, microbial, acoustically, and ballistically shielded space within a building or other personal space. The panels are comprised of an ionizing radiation shielding material layer, a non-ionizing radiation shielding layer, an anti-microbial treated layer, a bulletproof layer, and an acoustical shielding layer. A method is provided for using said panels to create a radiation, microbial, acoustically, and ballistically shielded space.

11 Claims, 2 Drawing Sheets

(56) References Cited

U.S. PATENT DOCUMENTS

| | | | | |
|---|---|---|---|---|
| 5,220,952 | A | 6/1993 | Beaulieu | |
| 5,349,893 | A * | 9/1994 | Dunn | 89/36.05 |
| 5,613,543 | A | 3/1997 | Walton | |
| 5,875,597 | A | 3/1999 | Gingrich et al. | |
| 6,295,648 | B2 * | 10/2001 | Siman-Tov et al. | 2/2.5 |
| 6,584,736 | B2 | 7/2003 | Szymanski et al. | |
| 6,660,403 | B2 * | 12/2003 | Ragland et al. | 428/594 |
| 7,064,280 | B1 * | 6/2006 | Rodgers | 174/384 |
| 7,078,098 | B1 * | 7/2006 | Woodside et al. | 428/378 |
| 7,196,023 | B2 * | 3/2007 | Langley et al. | 442/131 |
| 7,350,772 | B2 | 4/2008 | Legrand | |
| 7,600,608 | B2 | 10/2009 | Freiheit | |
| 8,091,605 | B1 * | 1/2012 | Melhart | A47G 5/00 160/135 |
| 8,359,965 | B2 * | 1/2013 | Oxford | F41H 3/00 89/36.02 |
| 8,850,947 | B2 * | 10/2014 | Oxford | F41H 3/00 89/36.01 |
| 2005/0262999 | A1 * | 12/2005 | Tomczyk et al. | 89/36.02 |
| 2006/0037719 | A1 | 2/2006 | Dalling | |
| 2007/0116933 | A1 * | 5/2007 | Kobayashi et al. | 428/172 |
| 2008/0282876 | A1 * | 11/2008 | Leivesley et al. | 89/36.02 |
| 2009/0071322 | A1 * | 3/2009 | Oxford | F41H 3/00 89/36.02 |
| 2012/0152468 | A1 * | 6/2012 | Melhart | A47G 5/00 160/120 |
| 2014/0020550 | A1 * | 1/2014 | Oxford | F41H 3/00 89/36.02 |
| 2015/0020679 | A1 * | 1/2015 | Oxford | F41H 3/00 89/36.02 |

OTHER PUBLICATIONS

Reflective Sheeting products brochure from TruProtect, retrieved on Jul. 12 2016.*

* cited by examiner

APPARATUS AND METHOD FOR BROAD SPECTRUM RADIATION ATTENUATION

This application is a continuation of U.S. patent application Ser. No. 13/751,696, filed Jan. 28, 2013, which is a continuation of U.S. patent application Ser. No. 11/901,698, filed Sep. 17, 2007, now issued as U.S. Pat. No. 8,359,965, by J. Craig Oxford, et al., and is entitled to those filing dates for priority. The specifications, figures and complete disclosures of U.S. application Ser. Nos. 13/751,696 and 11/901,698 are incorporated herein by specific reference for all purposes.

FIELD OF INVENTION

This invention relates to panels for use in assembling a radiation, microbial, acoustic, and ballistic shielded space within a building. In particular, this inventions relates to a modular scheme of inter-fitting panels to allow shielding to be accomplished in not only a room, but for use in head boards, concentric arcs, self-contained free-standing environments or other personal spaces.

PRIOR ART

Electromagnetic fields (EMF) are present everywhere in the environment but are invisible to the human eye. Radiation from an EMF can be broken down into ionizing and non-ionizing radiation. Ionizing radiation carries so much energy per quantum that they can break bonds between molecules. Examples of ionizing radiation are gamma rays, cosmic rays, and X-rays. Non-ionizing radiation does not carry enough energy per quantum to break bonds between molecules. Examples of non-ionizing radiation are microwaves, radio waves, and visible light.

The time-varying EMF produced by electrical appliances are an example of extremely low frequency (ELF) fields. ELF fields generally have frequencies up to 300 Hz. Other technologies produce intermediate frequency fields (IF) with frequencies from 300 Hz to 10 MHz and radiofrequency fields (RF) with frequencies of 10 MHz to 300 GHz. The effects of EMF fields on the human body depend not only on their field level, but also on their frequency and energy. Our electricity supply and all appliances using electricity are the main sources of ELF fields; computer screens, anti-theft devices and security systems are the main sources of IF fields; and radio, television, radar and cellular telephone antennas, and microwave ovens are the main sources of RF fields. These fields induce currents within the human body, which if sufficient can produce a range of effects such as heating and electrical shock, depending on their amplitude and frequency range Radiation shielding materials are well known in the art and materials typically used for ionizing radiation sources include lead, polyethelene, lead/tin and lead/bismuth amalgams. Nickel coated carbon fibers and other non-woven metalized fibers are lightweight, flexible materials and are ideal for shielding against non-ionizing radiation. Mumetal foil is known in the prior art as a low frequency magnetic shielding material.

Complete shielding against electric and magnetic fields requires a "Faraday Cage". Simply put, a Faraday cage is a structure, which is electrically conductive and/or magnetically permeable, which completely surrounds a defined volume of space in all three physical dimensions. For example, a room can be made into a Faraday Cage if all the walls, the floor, the ceiling and all openings are screened. In fact such an environment is used in making sensitive radiofrequency measurements. In that context it is usually called as "screen room". This invention can accomplish a Faraday cage to create a wideband screen room which would shield against electric and magnetic fields as well as ionizing radiation, but all the surfaces would need to be treated and all operable openings (i.e. door) would need to be equipped with the shield as well as a method of insuring its continuity when the door is closed.

In an effort to prevent or mitigate bacterial colonization on the surfaces of implant and medical devices, manufacturers have been investigating surface modification technologies, specifically surface coatings that are engineered to release bactericidal agents in a controlled manner. While these antimicrobial products are primarily being developed for medical devices to prevent the formation of biofilms, they are not just for medical devices and are well known in the prior art and include silver containing coatings, micro-encapsulated bi-neutralizing agents, and nano-coatings known to kill viral and bacterial microbes when exposed to light. This invention incorporates anti-microbial coatings on the layer exposed to the radiation, acoustical and ballistically shielded space's occupants.

When sound strikes a surface, some of it is absorbed, some of it is reflected and some of it is transmitted through the surface dense surfaces, for the most part, will isolate sound well, but reflect sound back into the room. Porous surfaces, for the most part, will absorb sound well, but will not isolate. The main way to minimize sound transmission from one space to another is adding mass and damping, which is well known in the art.

Visco-Elastic materials are most commonly used to damp vibration and minimize the transference of sound vibration and are used in a constrained layer damping system (CLD). The damping materials serve to dissipate energy. Visco elastic foam is effective in eliminating most sound transference, but low-frequency sound waves are long and strong and they are the toughest to control. SheetBlok is a dense, limp-mass vinyl material that is about 6 dB more effective than solid lead at stopping the transmission of sound. It acts as a thick, dense sound barrier layer in walls, ceilings or floors and is most effective when used as one component of a multi-layered construction scheme. Ideally, SheetBlok sandwiched in between two layers of visco-elastic acoustical foam held together by a spray adhesive such as Foamtak would provide an ideal acoustical shielding material.

Bulletproof and ballistic materials are well known in the art. Examples include Kevlar®, Twaron®, Dyneema®, Zylon® and even polyethelene. This invention incorporates the use of a ballistic material layer.

Radiation shielding for use within a building is well known in the art. Typically, such systems are incorporated into the building structure during its initial construction or retrofitted by demolishing existing interior structural surfaces and refitting the space with shielding materials and new structural surfaces. Additionally, U.S. Pat. No. 7,064,280 provides for a modular construction system wherein a plurality of panels which include radiation shielding material, such as lead, are provided for securement to the structural surfaces existing in a room. However, none of the prior art combines layers to produce simultaneous radiation, microbial, acoustical and ballistic shielding.

SUMMARY OF THE INVENTION

A panel for use in assembling a radiation, microbial, acoustic, and ballistic shielded space within a building. The panel is comprised of a layer of low frequency magnetic radiation shielding material, a layer of ionizing radiation shielding material, a layer of non-ionizing radiation shielding material, a layer of anti microbial treated material, a layer of bulletproof material and a layer of acoustical shielding materials. The panels can be used in bed head boards, concentric arcs, self contained free standing environment or other personal space. If the acoustical layer is removed, the panels can be used in articles of clothing such as an apron to provide a radiation, ballistic and microbial shielding.

From another aspect, a method is provided for adding radiation, microbial, acoustical, and ballistic shielding to a building or other personal space. The method includes the step of providing a plurality of inter-fitting modular panels. Each of the panels has a layer of low frequency magnetic radiation shielding material, a layer of ionizing radiation shielding material, a layer of non-ionizing radiation shielding material, a layer of anti microbial treated material, a layer of bulletproof material and a layer of acoustical shielding materials. The method also includes the step of mounting the plurality of inter-fitting panels to the structural surfaces of a room or other personal space.

DETAILED DESCRIPTION OF THE INVENTION

The present invention seeks to provide modular panels that will provide a radiation, microbial, acoustic, and ballistic shielded space within a building or other personal space. In a preferred embodiment, wall panels approximately 4'×8' containing multiple shielding layers are joined together to provide protection and shielding from both ionizing radiation and non-ionizing radiation as well as providing anti microbial protection, sound damping, and protection from certain ballistics such as bullets. The present invention additionally seeks to provide modular panels that can be incorporated into an article of clothing to provide a radiation, ballistic and microbial shielded layer of clothing.

In a preferred embodiment of the present invention, mumetal foil or other suitable low frequency magnetic shielding material is used as a low frequency magnetic shielding layer.

In a preferred embodiment of the present invention, the ionizing radiation shielding layer is comprised from either lead, lead amalgams, polyethylene or other suitable ionizing radiation shielding material. The advantage to using a thin layer (approximately 1 mm) of lead is that if the layers are electrically joined then rF shielding is also achieved. The advantage to using polyethylene is that polyethylene is lightweight and also has ballistic shielding properties eliminating the use for further ballistic materials.

In a preferred embodiment of the present invention, the non-ionizing radiation shielding layer is comprised from non-woven metallized fibers or other suitable non-ionizing radiation shielding material.

In a preferred embodiment of the present invention, the anti-microbial layer is comprised of a permanent nano-coating known to kill viral and bacterial microbes when exposed to light. Alternative embodiments of the anti microbial layer include a silver containing anti microbial or a bi-neutralizing agent (BNA) anti microbial that is micro encapsulated. The coating can be painted on the acoustically shielded outer layer of the panels.

In a preferred embodiment of the present invention, the ballistic layer is comprised of a layer of bulletproof material selected from the group comprising Kevlar®, Twaron®, Dyneema®, Zylon®, or other suitable ballistic material. In an alternative embodiment, if polyethylene is the material used in the ionizing radiation layer, no further bulletproof material is necessary to accomplish the ballastically shielded layer.

In a preferred embodiment of the present invention, the acoustically shielded layer is comprised of a layer of mass loaded dampening material such as a dense, limp mass vinyl material and a layer of visco-elastic acoustical foam which can be open cell, closed cell, with a skin, permeable, or non-permeable with skin to support bactericidal agent, with the acoustical foam layers being joined to the mass loaded dampening material by an adhesive layer.

A further embodiment of the present invention eliminates the acoustical shielding properties to provide a lightweight panel that provides radiation, ballistic and microbial shielding for use in articles of clothing.

A further embodiment of the present invention is to create a Faraday Cage out of the panels. For the magnetic and ionizing radiation layers of the shield it is sufficient to overlap them at the junctions between panels. The electrically conductive layer should be explicitly interconnected between panels although in some cases this can be achieved by simple overlapping. For example shielding material made of a non-woven fabric comprising nickel-coated graphite or carbon fibers, if overlapped will provide adequate continuity. This is because the nickel does not corrode or oxidize.

Regarding the acoustical shielding properties, the layer of the system closest to the occupant can utilize various plastic foams, usually reticulated, for control of the interior acoustics. The present invention utilizes non-flat surface topologies on the outer layer of the acoustical foam, which serves both a decorative purpose and has the acoustical utility of simultaneously providing absorption and diffusion. The preferred surface topolgy consists of an undulating surface in the x and z dimensions, which is visually aperiodic but is in fact periodic at the panel boundaries. This allows panels to be contiguous with no step discontinuity in the surface. Avoiding contour in the y dimension eliminates projecting horizontal surfaces upon which dust and dirt can collect.

Turning to FIG. 1, there is shown a perspective view of shielding panel 1 for use in assembling a radiation, microbial, acoustic and ballistic shielded space within a building. Turning to FIG. 2, the layer closest to the wall, 2, is mumetal foil or other suitable low frequency magnetic shielding material that is contiguous between adjacent layers. The next layer out, 3, is polyethelene or other suitable ionizing radiation shielding material, which is overlapped between adjacent panels. The next layer out, 4, is comprised of a suitable non-woven metalized fiber for providing non-ionizing radiation shielding, which is overlapped between adjacent panels as shown by 9. The next layer out, 5, is comprised of a mass loaded material for acoustical shielding purposes that is contiguous between adjacent layers. The last layer which is furthest from the wall is comprised of acoustical foam, 6, that is contiguous between adjacent layers and is treated with a suitable anti microbial coating, 7. The corresponding layers of adjacent panels do not need to be interconnected to achieve the shielding objectives; however, the acoustical dampening layers can be contiguous and the shielding layers need to be overlapped. The acoustical foam layer is comprised of an undulating surface in the x and z dimensions, which is visually aperiodic but is actually periodic at the panel boundaries.

The layers are bonded by means of an adhesive layers 8. Adhesive layers 8 may be any of a polyimide, phenolic, polyurethane, epoxy, acrylic or silicone adhesive composition. Using the above mentioned sequence of shielding materials eliminates the need for explicit electrical insulating layers, but if a different sequence is used insulating layers of polyamide film can be incorporated.

The same sequence of layers can be used to form modular panels that can be used in various ways including, but not limited to bed head boards, concentric arcs, self contained free standing environments or other personal spaces.

Figure 1:
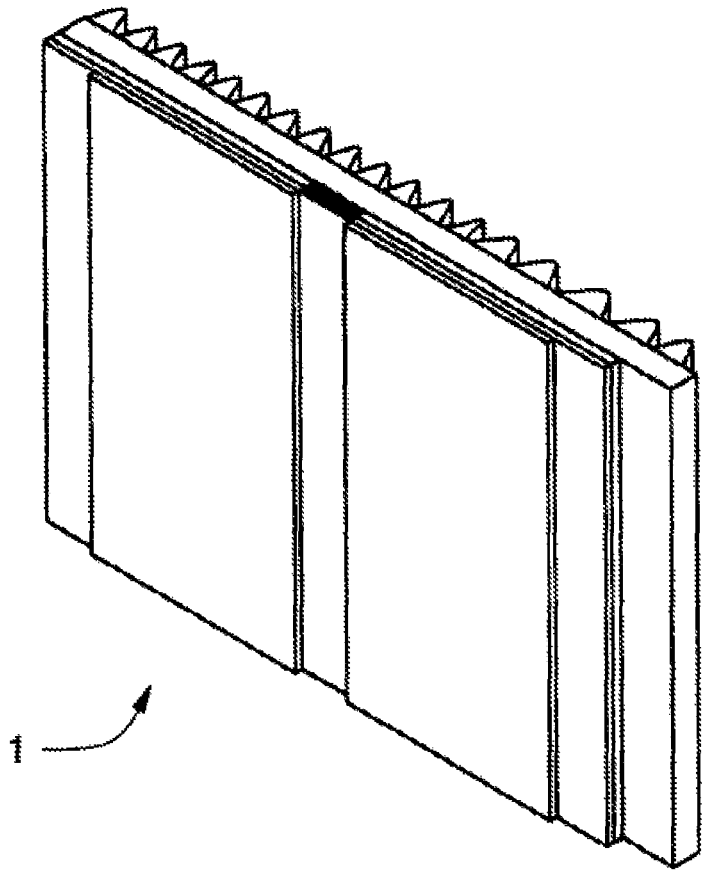
FIG. 1 shows a perspective view of shielding panel for use in assembling a radiation, microbial, acoustic and ballistic shielded space within a building.
Figure 2:
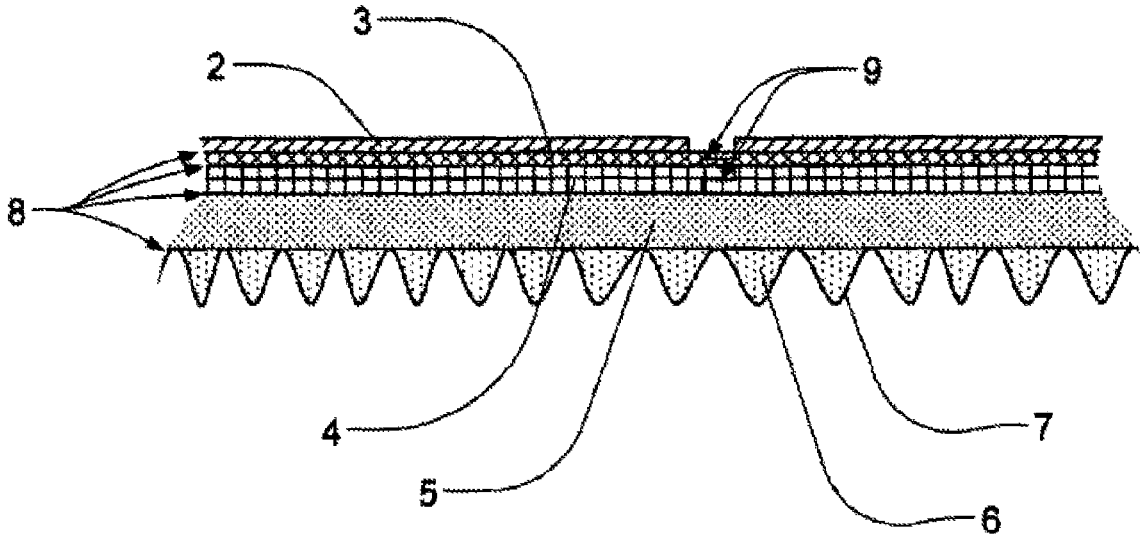
FIG. 2 shows an idealized arrangement for the different layers of a shielding panel for use in assembling a radiation, microbial, acoustic and ballistic shielded space within a building.

What is claimed is:

1. A system for assembling a shielded space, comprising:

a plurality of rigid multi-layered panels with a top edge, a bottom edge, a right edge and a left edge, each panel comprising (a) a low frequency magnetic shielding layer, (b) an acoustical foam shielding layer, said acoustic foam shielding layer comprising an undulating surface topology, and (c) an ionizing radiation shield layer;

wherein the right edge and left edge of adjacent panels are adapted to connect to each other.

2. The system of claim 1, further comprising:

a non-ionizing radiation shielding layer comprised of non-woven metallized fibers; and an anti-microbial layer.

3. The system of claim 1, wherein said ionizing radiation shielding layer is comprised of lead or lead amalgam.

4. The system of claim 1, wherein said ionizing radiation shielding layer is comprised of polyethylene.

5. The system of claim 1, wherein said one or more of said acoustical foam shielding layer is visually aperiodic but periodic at the edges of the panel.

6. The system of claim 1, wherein the multi-layer panels are adapted to be attached to the wall of a room.

7. The system of claim 1, wherein at least one of said panels is attached to the headboard of a bed.

8. The system of claim 1, wherein at least one of said panels is free-standing.

9. The system of claim 1, wherein said panels are 8 feet in height.

10. The system of claim 1, wherein the panel layers are bonded by an adhesive.

11. The system of claim 1, one or more of said panels further comprising a bulletproof layer.

* * * * *